US007237943B2

(12) United States Patent
Brown

(10) Patent No.: US 7,237,943 B2
(45) Date of Patent: Jul. 3, 2007

(54) DYNAMIC FLUID MIXER

(75) Inventor: Christopher John Brown, Glossop (GB)

(73) Assignee: Maelstrom Advanced Process Technologies, Ltd., Glossop, Derbyshire (GB)

( * ) Notice: Subject to any disclaimer, the term of this patent is extended or adjusted under 35 U.S.C. 154(b) by 80 days.

(21) Appl. No.: 10/416,217

(22) PCT Filed: Oct. 19, 2001

(86) PCT No.: PCT/GB01/04670

§ 371 (c)(1),
(2), (4) Date: Sep. 12, 2003

(87) PCT Pub. No.: WO02/38263

PCT Pub. Date: May 16, 2002

(65) Prior Publication Data

US 2004/0052156 A1 Mar. 18, 2004

(30) Foreign Application Priority Data

Nov. 10, 2000 (GB) ..... 0027623.8
Aug. 18, 2001 (GB) ..... 0120174.8

(51) Int. Cl.
*B01F 7/00* (2006.01)

(52) U.S. Cl. ..... 366/303; 366/305

(58) Field of Classification Search ..... 366/64–65, 366/96–99, 286, 303, 304, 305, 314, 315–317
See application file for complete search history.

(56) References Cited

U.S. PATENT DOCUMENTS 2,159,670 A * 5/1939 Neitzke ..... 366/196
2,278,051 A * 3/1942 Ambrose ..... 241/97
2,321,599 A * 6/1943 Hofmann ..... 241/261
2,591,966 A * 4/1952 Rider ..... 366/286
2,627,394 A * 2/1953 Spencer ..... 366/76.1
2,645,464 A * 7/1953 Forbes ..... 366/304
2,706,108 A 4/1955 Miner
2,731,253 A * 1/1956 Spencer ..... 261/118
2,995,346 A * 8/1961 Samples ..... 366/98
3,081,069 A * 3/1963 Oakes ..... 366/304
3,231,242 A * 1/1966 Schrier ..... 366/304
3,709,664 A * 1/1973 Krekeler et al. ..... 422/225

(Continued)

FOREIGN PATENT DOCUMENTS

CH 355770 7/1961

(Continued)

*Primary Examiner*—Charles E. Cooley
(74) *Attorney, Agent, or Firm*—Woodard, Emhardt, Moriarty, McNett & Henry LLP

(57) ABSTRACT

A dynamic mixer in which two elements are rotatable relative to each other about a predetermined axis and between which is defined a flow path extending between an inlet for materials to be mixed and an outlet. The flow path is defined between surfaces of the elements each of which surfaces defines a series of annular projections (8, 12) centred on the predetermined axis (10). The surfaces are positioned such that projections defined by one element extend into spaces between projections (12) defined by the other element. At least one cavity is formed in each projection (8, 12) to define a flow passage bridging the projection in which the cavity is formed. Each of the elements may be generally conical althrough each of the elements could be generally cylindrical or planar, providing projections in the two elements overlap.

3 Claims, 12 Drawing Sheets

U.S. PATENT DOCUMENTS

| | | | | | |
|---|---|---|---|---|---|
| 3,845,938 | A | * | 11/1974 | Schold | 366/144 |
| 4,092,738 | A | | 5/1978 | Doom | |
| 4,128,342 | A | * | 12/1978 | Renk | 366/99 |
| 4,176,972 | A | * | 12/1979 | Stiling | 366/304 |
| 4,231,666 | A | * | 11/1980 | Baron | 366/304 |
| 4,431,482 | A | * | 2/1984 | Heinbockel et al. | 162/243 |
| 4,610,548 | A | * | 9/1986 | Hallet et al. | 366/279 |
| 5,088,831 | A | * | 2/1992 | Reinhall | 366/171.1 |
| 5,141,328 | A | * | 8/1992 | Dilley | 366/305 |
| 5,902,042 | A | * | 5/1999 | Imaizumi et al. | 366/176.2 |
| 6,648,500 | B2 | * | 11/2003 | Fedorov et al. | 366/285 |
| 6,651,839 | B2 | * | 11/2003 | Kriebel et al. | 221/1 |
| 6,866,412 | B2 | * | 3/2005 | Bachelier et al. | 366/294 |
| 2004/0052156 | A1 | * | 3/2004 | Brown | 366/286 |

FOREIGN PATENT DOCUMENTS

| | | | |
|---|---|---|---|
| CH | 355771 | | 7/1961 |
| DE | 2256900 | * | 5/1973 |
| DE | 3938306 | A1 * | 5/1991 |
| FR | 2446667 | * | 8/1990 |
| JP | 59-166231 | * | 9/1984 |
| JP | 63-49239 | * | 3/1988 |
| JP | 5-15756 | * | 1/1993 |
| JP | 5-15757 | * | 1/1993 |
| JP | 5-15758 | * | 1/1993 |
| JP | 5-15759 | * | 1/1993 |
| JP | 6-285354 | * | 10/1994 |
| JP | 8-141378 | * | 6/1996 |
| JP | 11-90212 | * | 4/1999 |
| JP | 2002-301363 | * | 10/2002 |
| WO | 80/01469 | * | 7/1980 |
| WO | 81/00816 | * | 4/1981 |
| WO | 02/38263 | * | 5/2005 |

* cited by examiner

DYNAMIC FLUID MIXER

BACKGROUND

The present invention relates to a dynamic mixer.

Dynamic mixers are known which comprise two elements which are rotatable relative to each other about a predetermined axis and between which is defined a flow path extending between an inlet for materials to be mixed and an outlet. In the known mixers, the flow path is defined between surfaces of the elements each of which surfaces has cavities formed within it. Cavities formed in one surface are offset in the axial direction relative to cavities in the other surface, and cavities in one surface overlap in the axial direction with cavities in the other surface. As a result, material moving between the surfaces is transferred between overlapping cavities. Thus, in use, material to be mixed is moved between the elements and traces a path through cavities located alternately on each of the two surfaces. The bulk of the material to be mixed passes through a shear zone in the material generated by displacement of the surfaces. Such mixers incorporating cavities are generally referred to as "cavity transfer mixers".

Cavity transfer mixers normally have a cylindrical geometry, that is an inner element having a generally cylindrical outer surface and which generally forms a rotor of the device and an outer element having a generally cylindrical inner surface which generally forms a stator of the device. Rows of cavities are formed in the two facing cylindrical surfaces, the rows of cavities overlapping in the axial direction such that material to be mixed generally passes from a cavity in one row of one surface into a cavity in an adjacent row of the other surface. Such conventional cylindrical cavity transfer mixers generally comprise a solid inner rotor which is housed within a split outer stator, it being necessary to manufacture the outer stator in splittable form so as to enable the formation of rows of cavities in the outer stator. The maximum outer diameter of the inner element is less than the minimum inner diameter of the outer element and therefore the mixer can be assembled relatively easily simply by axial insertion of the inner rotor into the outer stator. Given the relative dimensions of the inner and outer elements however an open annular space is defined between the two components.

Problems have been experienced with cylindrical-geometry cavity transfer mixers. In particular, material can pass straight through the annular space defined between the two elements without entering the cavities. This is a particular problem with materials of relatively low viscosity. For example, when materials of dissimilar viscosity are being mixed, materials of relatively low viscosity can effectively short circuit the cavities by travelling straight through the annular space.

A further problem with cylindrical geometry cavity transfer mixers is that asymmetrical transfers can be generated which cause axial back flow or front flow that can generate stagnation patterns with the result that material can become deposited or "hang-up" in the cavities. This is a particular problem when mixing reacting materials and can result in material degradation and uneven flow rates.

Further disadvantageous features of cylindrical geometry cavity transfer mixers is that they are not self pumping or self cleaning. Given that the material flow path through the cavities cannot be directly observed, it is difficult to be sure that material has not become deposited within the cavities. If material does become deposited in one of the cavities, it is difficult to clean out unless the outer element of the structure is split, and even then cleaning is not a simple process.

The formation of cavities on the inner surface of the outer member is difficult to achieve unless the outer member is splittable and as a result manufacturing costs are high. Furthermore, given that the outer element is generally splittable for manufacture and cleaning, leakage can occur through joints in the outer element. These problems have severely, restricted the application of cylindrical geometry cavity transfer mixers.

It is known from for example U.S. Pat. No. 4,680,132 that cavity transfer mixers may have a planar geometry in which the cavities are formed in opposed planar surfaces rather than in opposed cylindrical surfaces. Such a planar geometry makes manufacture of the cavities in the opposed surfaces and cleaning of deposited material from the cavities relatively easier as compared with cylindrical geometries. Problems associated with material bypassing or being deposited within the cavities remain.

It is an object of the present invention to obviate or mitigate the problems outlined above.

SUMMARY

According to the present invention, there is provided a dynamic mixer comprising two elements which are rotatable relative to each other about a predetermined axis and between which is defined a flow path extending between an inlet for material to be mixed and an outlet, wherein the flow path is defined between surfaces of the elements each of which surfaces defines a series of annular projectors centred on he predetermined axis, the surfaces are positioned such that projections defined by one element extend towards spaces between projections defined by the other element, cavities are formed in each surface to define flow passages bridging the projections, cavities formed in one surface being offset in the axial direction relative to cavities in the other surface, and cavities in one source overlapping in the axial direction with cavities in the other surface such that material moving between the surfaces from the inlet to the outlet is transferred between overlapping cavities.

Preferably that the projections overlap in the direction perpendicular to the flow path so that projections on one element extend into spaces between projections on the other. With such an arrangement there is no free annular space linearly connecting inlet and outlet between the two relatively rotating elements. Whether or not there is such overlap, the probability of material bypassing the cavities defined in he projections is reduced as compared with a conventional cavity transfer mixer. Material entering a cavity in one direction is in effect redirected to exit that cavity in a different direction. Furthermore the juxtaposition of the cavities in adjacent projections is such that material to be mixed is substantially compelled to transfer from a cavity in one projection to a cavity in the adjacent projection, thereby ensuring that material to be mixed passes alternately between cavities in the two elements. The mixer thus provides a highly effective and efficient distributive mixing action.

Each projection may have an array of circumferentially spaced cavities formed with it. Each of the cavities may be part spherical or of any other geometric form suitable to define a flow path. In addition, each or some of the cavities may be branched such that material flowing along the flow passage defined by a cavity in a single projection is divided into separate streams before it exits that flow passage, or separate streams of material in different branches are combined.

Each projection may be defined by side surfaces each of which is a surface of revolution swept out by a straight or curved line rotated about the axis. For example, one of the two side surfaces of each projection may define a cylindrical surface centred on the axis. The other side surface could be perpendicular to the axis. The side surfaces may be arranged such that the gap between adjacent projections except where cavities are provided is substantially constant throughout the flow path. Other surface configurations are of course possible, e.g. a surface of revolution swept by one or more curved lines or by more than two straight lines.

The surfaces of elements which define the projections may be generally conical with the projections shaped such that an inner conical element can be positioned within an outer conical element by relative displacement between the two elements in a direction parallel to the rotation axis. Such an arrangement facilitates assembly without requiring one of the elements to be splittable into two halves and also makes it relatively easy to machine or otherwise form the projections and the cavities in the projections. Means may be provided for axially displacing the elements relative to each other during use to control the spacing between the generally conical surfaces. One surface may be defined by a inner surface of a hollow outer member and the other surface may be defined by an outer surface of a solid inner member, the inlet being defined in the outer member. Alternatively that arrangement could be reversed such that the inner member is hollow and the inlet is defined in the inner member. The two elements may define a double cone with a first section of the elements tapering outwards from the inlet and a second section of the elements tapering inwards to the outlet.

Adjacent projections may define different numbers, sizes or shapes of cavities. At least one element may support an impeller to provide a pumping effect when the two elements are rotated relative to each other.

The present invention also provides a method of mixing using an apparatus as defined above, operating at a relatively low speed to produce laminar flow conditions which will result in good distributive and low stress mixing.

The present invention further provides a method of mixing using an apparatus as defined above operating at a relatively high speed to produce turbulent flow conditions which will result in effective dispersive mixing.

Embodiments of the present invention will now be described, by way of example, with reference to the accompanying drawings, in which;

DESCRIPTION OF THE PREFERRED EMBODIMENTS

Figure 1:
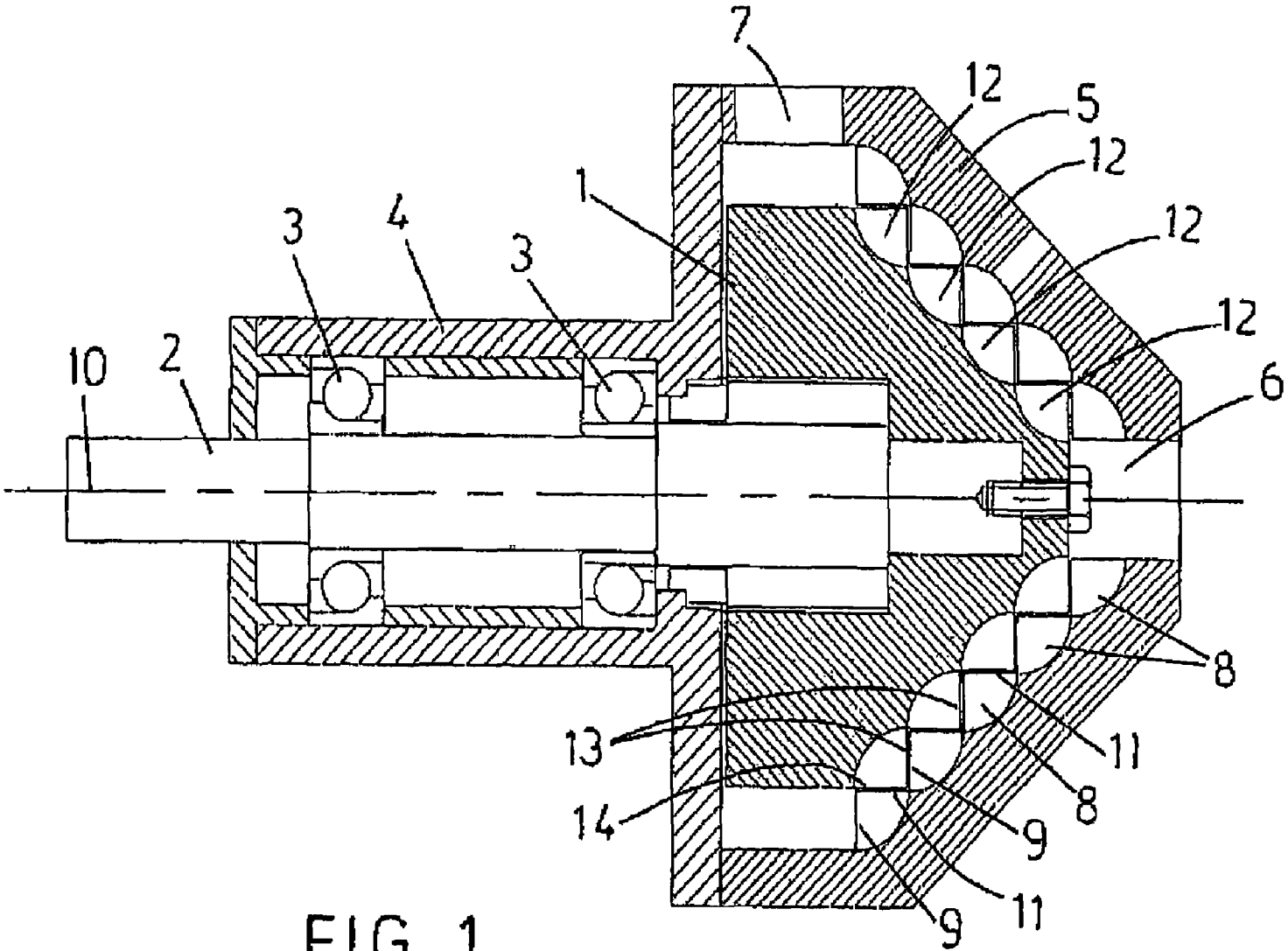
FIG. 1 is an axial section through a first embodiment of the present invention.

Referring to FIG. 1, the illustrated dynamic mixer comprises a rotor 1 mounted on a shaft 2 supported in bearings 3 within a stator housing 4. A stator 5 is mounted on the stator housing 4. The stator 5 defines a mixer inlet 6 and a mixer outlet 7. An array of five annular projections 8 extends along the generally conical inner surface of the stator 5, each projection being defined between a first surface 9 which is planar and perpendicular to an axis of rotation 10 and a second surface 11 which is cylindrical and centered to the axis 10.

The rotor 1 supports four projections 12 each of which is defined between a first annular planar surface 13 which is perpendicular to the axis 10 and a second cylindrical surface 14 which is centred to the axis 10. Thus the surfaces 11 and 14 are volumes of revolution swept out by lines parallel to the axis 10 and rotated about that axis. Similarly, the surfaces 9 and 13 are surfaces of revolution swept out by lines perpendicular to the axis 10 and rotated about that axis.

It will be appreciated that a small gap is defined between the opposed surfaces of the projections 8 and 12. That gap is not however linear and therefore material passing from the inlet 6 to the outlet 7 cannot follow a linear path. In addition to this general, configuration however a series of cavities is provided in each of the projections 8 and 12. These cavities are not shown in FIG. 1 with a view to avoiding overcomplication of FIG. 1 but the cavities are shown in FIGS. 2 to 4.

Figure 2:
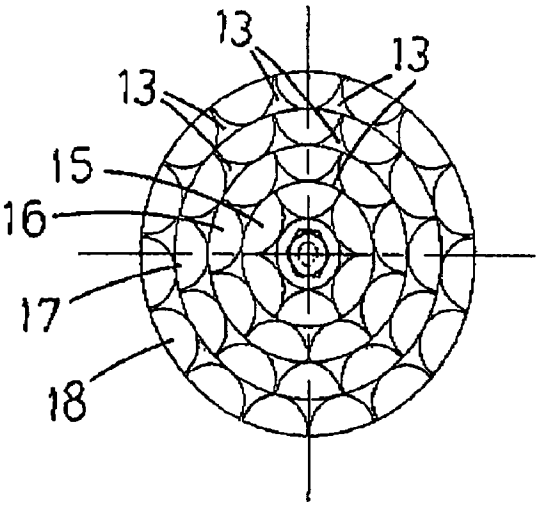
FIG. 2 is an end view of an inner rotor element of the assembly of FIG. 1.

Referring to FIG. 2, the planar surfaces 13 which define one side of each of the projection 12 is shown. In each of these planar surfaces an equally spaced array of cavities is formed. In the innermost projection, six cavities 15 are formed. In the next projection, nine cavities 16 are formed. In the next projection, twelve cavities 17 are formed. In the outer projection, fifteen cavities 18 are formed. Each of the cavities is part-spherical and arranged such that the periphery of each cavities extends across the full width of the surface 13 and the full width of the surface 14.

Figure 3:
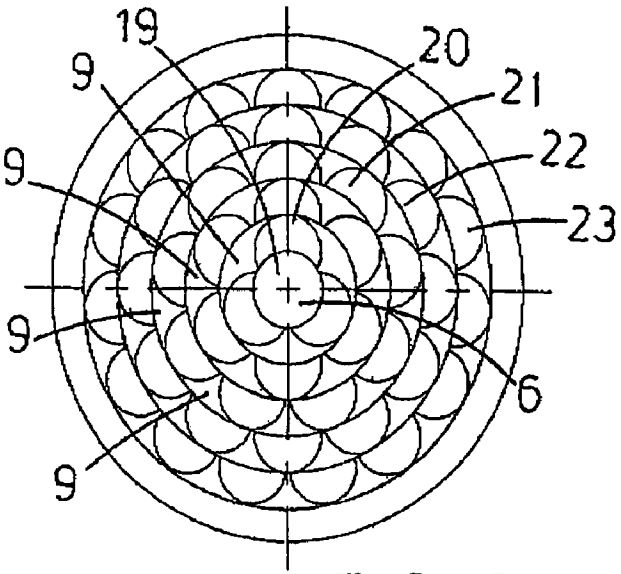
FIG. 3 is an end view of an outer stator element of the assembly of FIG. 1.

Referring to FIG. 3, this shows the cavities formed in the stator and the central aperture defining the mixer inlet 6. Five surfaces 9 extend around the inlet and an array of cavities is formed in each of the surfaces 9. There are three cavities 19 in the innermost array, six cavities 20 in the next array, nine cavities 21 in the next array, twelve cavities 22 in the next array, and fifteen cavities 23 in the outer array. Each of the cavities is formed so as to just extend fully across the surface 9 and fully across the surface 11 defining the other side of the projection.

Figure 4:
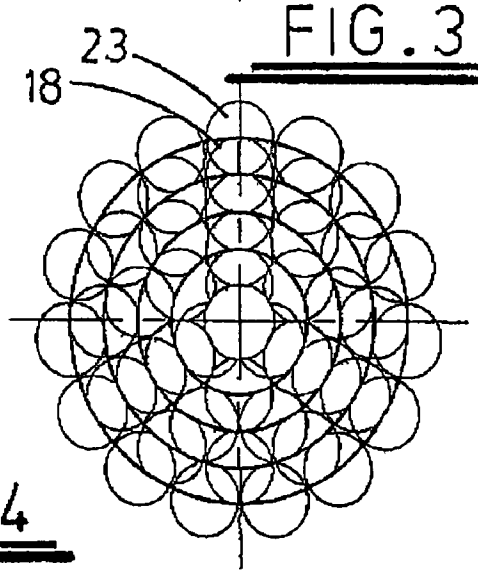
FIG. 4 represents the relative disposition of cavities in the two elements which are combined in the assembly of FIG. 1.

FIG. 4 shows the relative disposition of the various cavities in the two components. Given that adjacent projections define differing numbers of cavities, the paths of least resistance through the mixer vary continuously as the rotor turns within the stator. Material to be mixed thus follows a complex path which ensures adequate mixing.

The gap between the two relatively rotating elements where no cavities are provided results in a highly effective and efficient dispersive mixing action by subjecting the material to be mixed to intensive shear stresses. Adjustment of the relative axial positions of the rotor 1 and stator 5 although not possible in the arrangement shown in FIG. 1 would provide additional control of the spacing between the surfaces 9 and 13 so as to provide an additional adjustable control mechanism. Such adjustment would result in different levels of shear stressing on the material being transferred between cavities in the adjacent elements. Such a variation could be performed during manufacture or during operation by providing a mechanism to control axial movement of one element relative to the other.

The flow path of material passing through the gap between the elements is dominated by the movement of the majority of the material passing from a flow passage defined by a cavity in one projection on one element to a flow passage defined by a cavity in an adjacent projection on the other element. This action prevents material from passing through the mixer without entering the flow passages defined by the cavities.

The mixer comprises interfacial surfaces at varying distances from the axis of rotation. The difference in the kinetic energy imparted by these surfaces to a material being mixed provides a motive force to the material that tends to propel it through the mixer. The result is a pumping action which reduces the possibility of material becoming lodged within the mixer. It will be appreciated that the arrangement could be reversed however such that the material is forced, by some external pumping means, to flow radially inwards, reversing the inlet and outlet. In such circumstances the inherent centrifugal pumping action provides back pressure and a more intensive mixing action. An application of such an a arrangement would be as an in-line mixer in which some degree of back-mixing is required.

The flow passages defied by the cavities can be shaped to increase the pumping action and the propulsive forces thus obtained ran be used to pump material through the mixer and to empty the mixer at the end of its mixing operation. As a result this pumping action makes it possible to use the mixer both as an in-line mixing device and a batch mixing device.

A structure such as that illustrated in FIGS. 1 to 4 is relatively easy to manufacture given that the surfaces of the two elements in which the projections and cavities are formed are accessible along one axis.

In the illustrated embodiment the flow passages are part-spherical but it will be appreciated that different cavity shapes, sizes and numbers could be provided having either curved or rectilinear sides.

Given that the number and/or size and/or shape of the cavities may be varied as between adjacent projections, generally in accordance with the pitch circle radius of the projections around the axis of rotation, the material to be mixed is forced to split into different streams as it passes through the mixer. This insures a relatively good mixing performance. Each of the flow passages presents a well defined entrance zone and exit zone to material passing from the inlet to the outlet. The relative sizes of these entrance and exit zones could be controlled so at to be different within one cavity, within one row of cavities, or between rows of cavities. This ability to vary the relative sizes between entrances and exits to cavities enables the local flow characteristics to be adjusted to provide varying flow velocities and pressures. For example, decreasing the local cross-sectional area of a flow passage defined by a cavity would increase the velocity of the flow through the cavity and decrease its pressure. The ability to vary the relative sizes between entrances and exits also permits the material flowing from a relatively large exit to be more finely divided by compelling it to flow into relatively smaller entrances defined by de downstream cavities. This enables the distributive and dispersive mixing characteristics to be adjusted and optimised. This effect may be further enhanced by causing an individual cavity to be branched between its entrance and exit. Thus a number of entrances may be joined to a single exit, or a single entrance may be joined to a number of exits. This would further increase the distributive mixing action obtained by combining the streams of material passing through individual cavities either within or between adjacent cavities.

Figure 5:
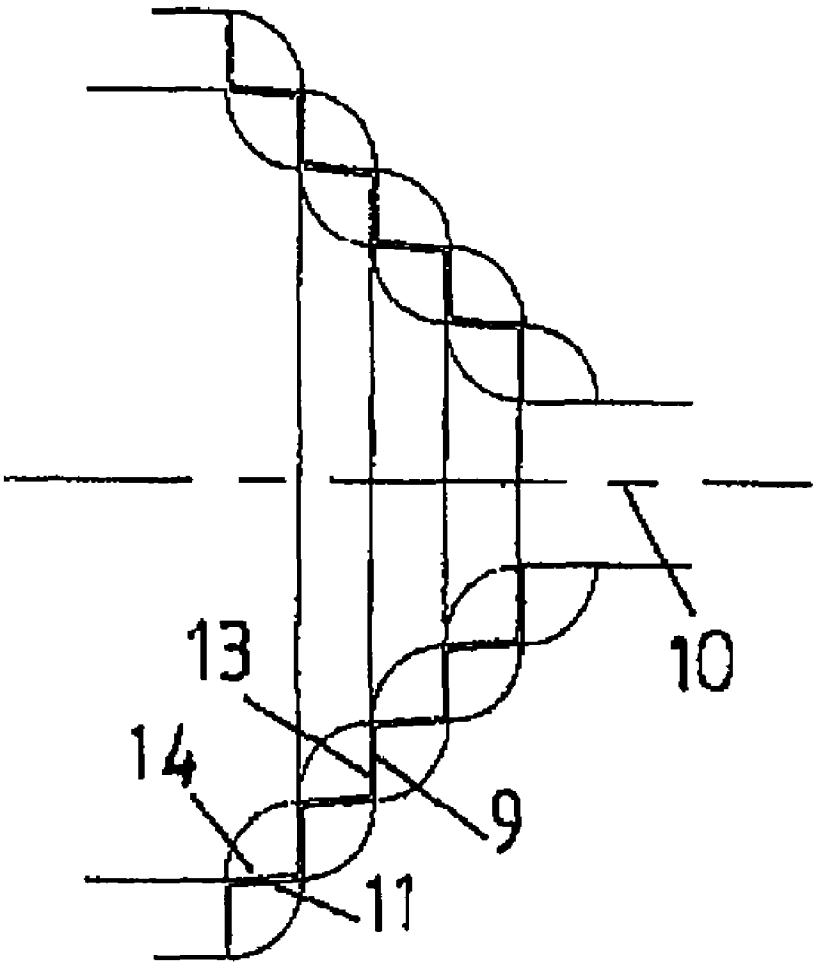
FIG. 5 is an axial representation of a configuration of projections provided in a second embodiment of the present invention.

In the embodiment of FIGS. 1 to 4, the surfaces 9 and 11 are mutually perpendicular as are the surfaces 13 and 14. Other arrangements are possible however, for example as shown in FIG. 5 where the surfaces 11 and 14 are shown as generally frusto-conical with the cones centred on the axis 10. With such a configuration, relative axial displacement between the two rotating elements changes the spacing between the surfaces 11 and 14 as well as the spacing between the surfaces 9 and 13.

Figure 6:
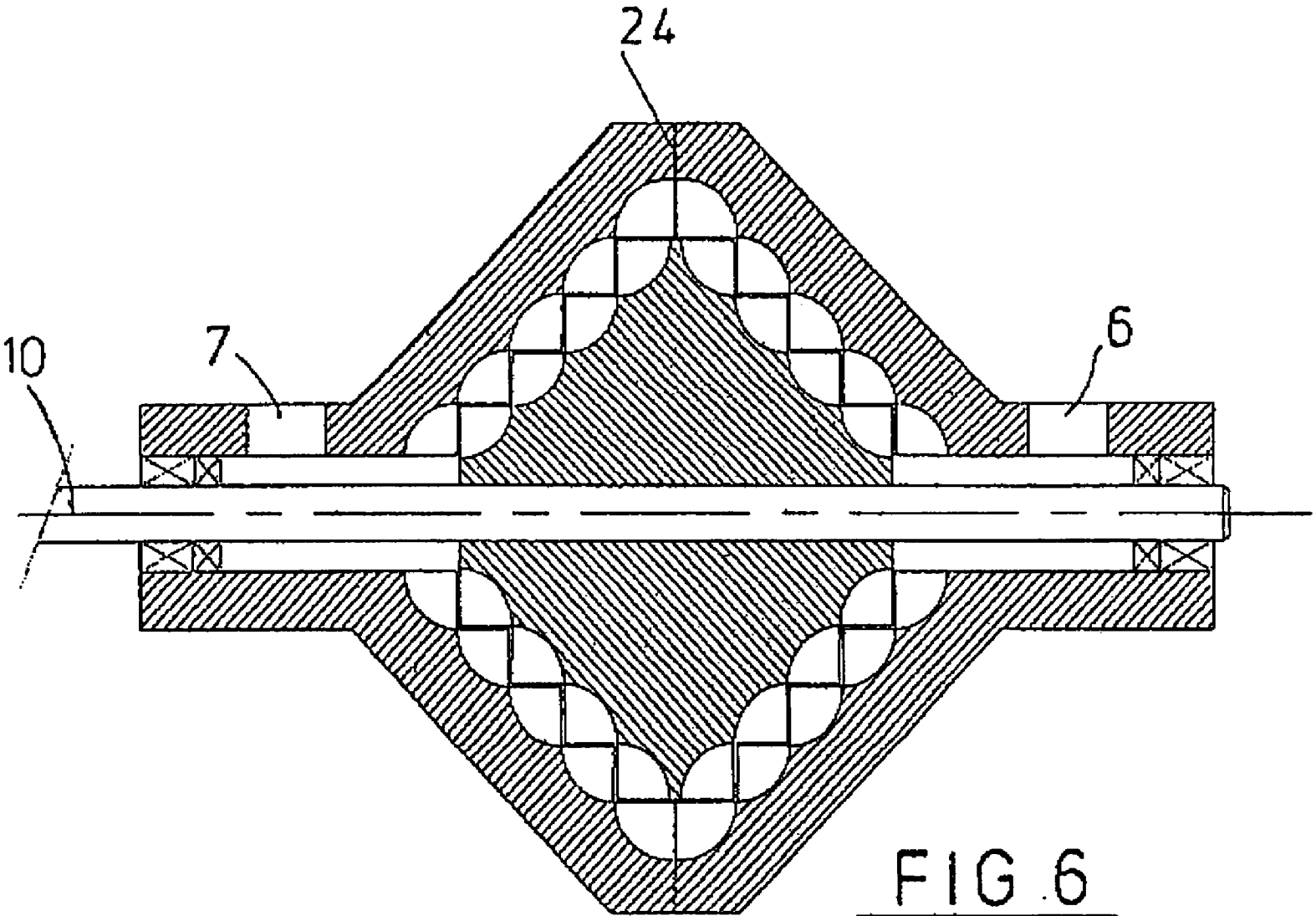
FIG. 6 is an axial section through a third embodiment of the present invention.

In an alternative arrangement illustrated in FIG. 6, in contrast of the single conical arrangement of FIG. 1 it is possible to have a double conical arrangement in which both the inlet 6 and outlet 7 are adjacent the rotation axis 10. With such an arrangement however it is generally necessary for the stator to be splittable, for example along the line 24.

Various advantages arise with the mixer in accordance with the present invention as compared with conventional cylindrical configuration cavity transfer mixers. In particular, the projections define a large number of mutually inclined surfaces which ensure inter-cavity transfers between the two mutually rotating elements. The projections define a large number of cutting edges and the absence of an open annular space between the two elements ensures that all the material to be mixed is exposed to active mixing. Inter-cavity transfers can be achieved at low turbulence/low shear if required. Equally, inter-cavity transfers at high turbulence/high shear can be achieved if required. With mixers in accordance with the invention in which a generally conical structure is provided and the number and/or size and/or shape of cavities per projection varies, the differences between the cavities of adjacent projections as the material progresses through the mixer can be such as to ensure material is forced to split into different streams as it passes between adjacent projections. It will be appreciated however that a generally cylindrical or generally planar configuration could be provided, and such arrangements could also have different numbers, sizes and shapes of cavities in adjacent projections. The shear rates and stresses may be readily adjusted by appropriate dimensional adjustments made either at the time of manufacture or during use.

As noted above, different cavity shapes may be used to adjust characteristics. The cavity shapes can be selected for example to maximise centrifugal pumping action, even to the extent of being curved into the form of vanes in the manner of a conventional centrifugal pump. Cavity shapes can also be selected to optimise vortex formation within any individual cavity and interactions between such vortices, to optimise flow velocities and pressures, and to enhance the degree of distributive mixing between consecutive projections. Gaps could be provided between adjacent projections to ensure that additional blending zones are defined which generate multiple vortices. This can be achieved simply by omitting one of the projections from a central section of the embodiment of FIG. 1 for example. Alternatively, some projections may be formed without any cavities; or cavities may be formed in the troughs between adjacent projections rather than being centred on the peaks of the projections as in the illustrated embodiments.

Designs may be compact to make it possible to achieve a low-pressure drop through the mixer. Mixers can be designed to optimise self-cleaning through centrifugal pumping action. With conical arrangements manufacture is relatively simple. Monolithic constructions may be provided to avoid problems with sealing splittable components. The designs can be mechanically robust, can be provided with additional injection ports (such a post is shown in the stator 5 of the embodiment of FIG. 1 adjacent the central projection B of the stator). Suitable heating/cooling capability can be easily built in. Flow directions may be reversible, although a radially outwards flow in a conical arrangement would be preferred if it is desired to minimise structural pressure drops and to provide a pumping action. Either the rotor or the stator or both could be rotatable. In some configurations material could be simply pumped through the assembly to achieve a static mixing action. Occasions on which the mixer is used as a static mixer will probably only arise in special circumstances, e.g. when minimal mixing is required for a particular product and it would be advantageous not to remove the mixer from a processing line, or during start-up of a process. Thus the mixer can provide some useful additional functionality as a static mixer.

Figure 7:
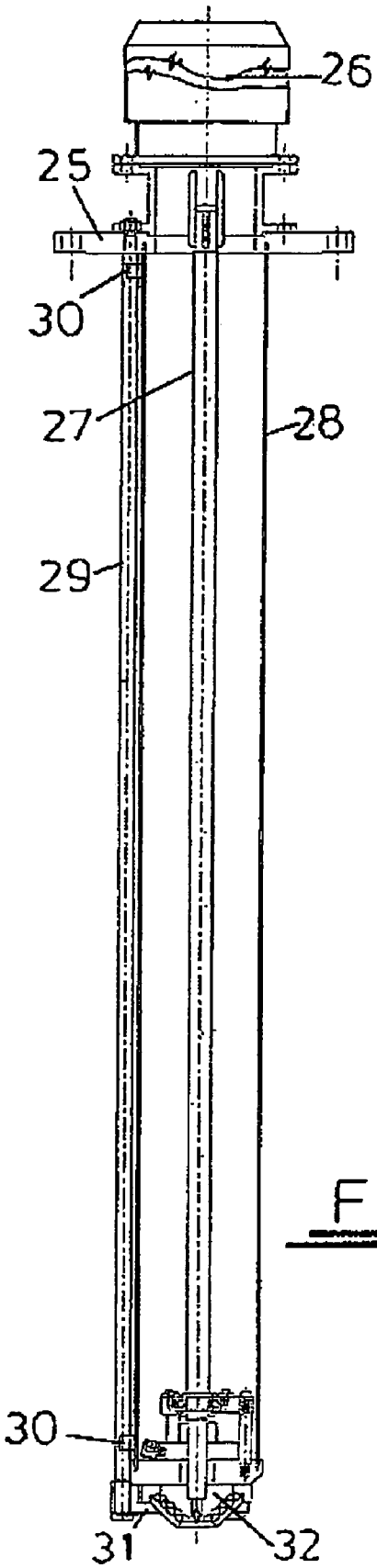
FIG. 7 is a side view of an apparatus in accordance with the present invention incorporating an external impeller.

FIG. 7 is a partially cut away side view of a batch mixing machine incorporating an external impeller. A mounting flange 25 enables the apparatus to be mounted on a container which in use will be filled with a material to be mixed. A drive motor 26 is mounted on the flange 25 and drives a shaft 27 extending along the axis of a tubular support member 28. Three support rods 29 which are braced against the tube 28 by brackets 30 support a hollow stator 31 which define an upwardly widening conical surface that receives a rotor 32.

Figure 8:
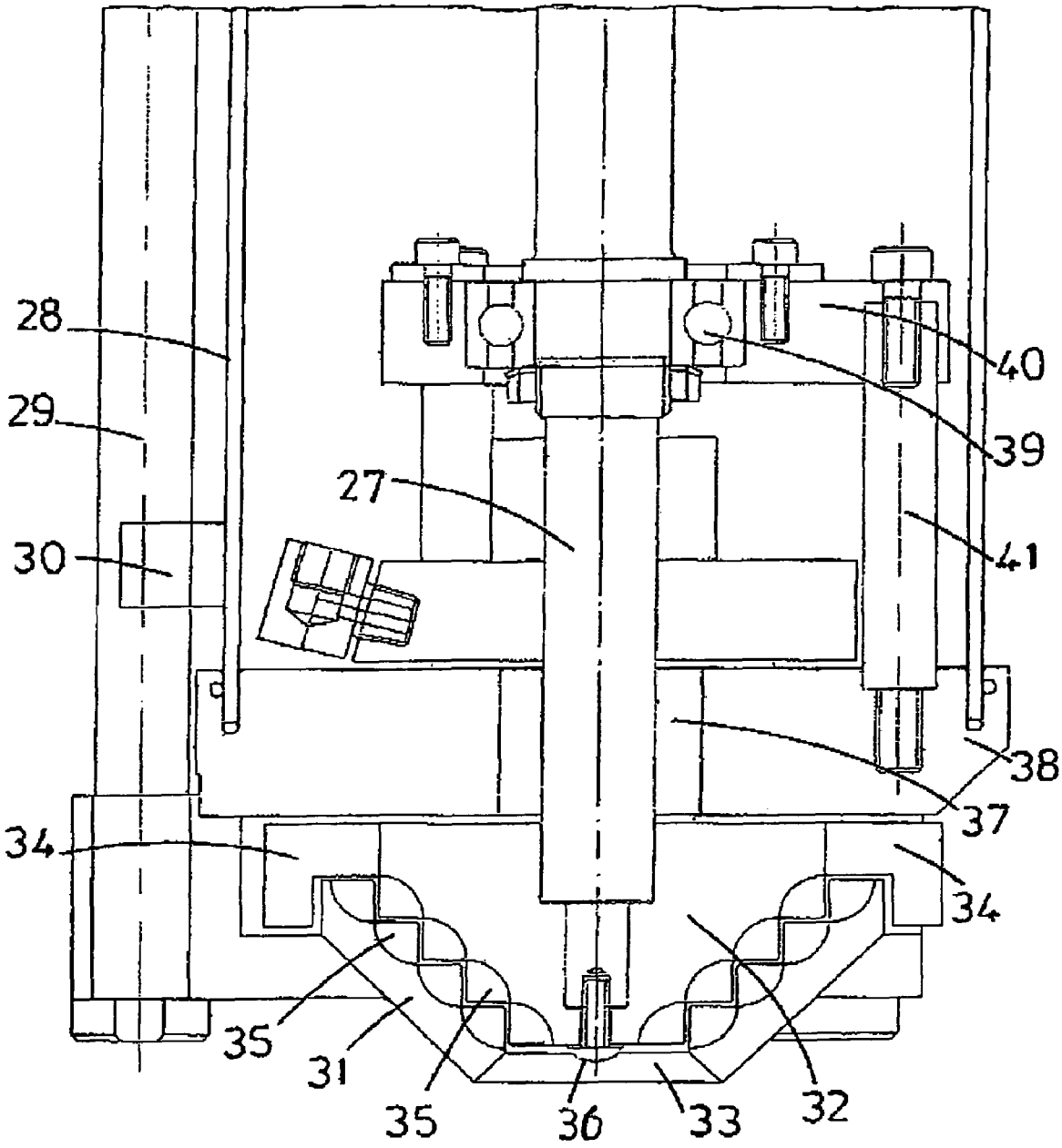
FIG. 8 is a view to a much larger scale of the mixing head of the arrangement of FIG. 7.

Referring to FIG. 8 which shows the rotor and stator structure in greater detail, the stator 31 defines an inlet 33 giving access to the underside of the rotor 32. The rotor supports impellers 34. Both the stator 31 and rotor 32 define four annular projections in each of which cavities 35 are formed. The rotor 32 is secured to shaft 27 by screw 36. The shaft 27 extends through a seal 37 mounted in a plate 38 which is itself sealingly supported by the tube 28 and a bearing 39 mounted in a support plate 40 which itself is supported on rods 41 extending from to plate 38.

When the assembly shown in FIG. 8 is immersed in a fluid and the rotor is driven in rotation, the impellers 34 provide an additional pumping force to at generated as a result of the interaction of the projections and cavities.

Figure 9:
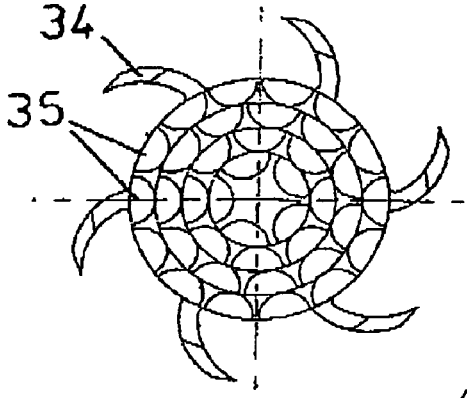
FIG. 9 is an end view of a rotor incorporated in the apparatus of FIGS. 7 and 8.
Figure 10:
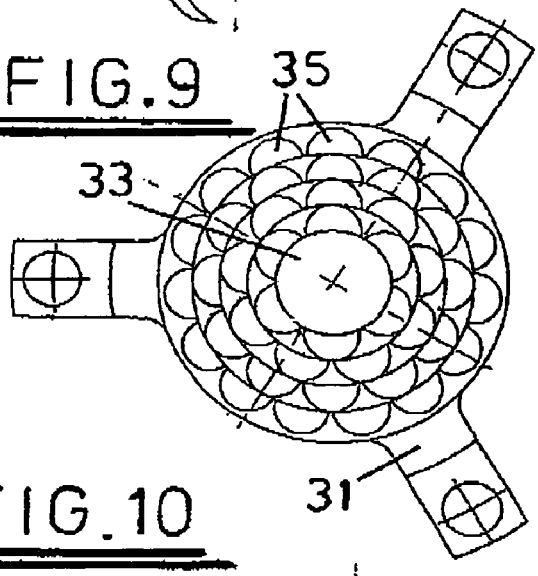
FIG. 10 is a view of a stator incorporated in the embodiment of FIGS. 7 and 8.
Figure 11:
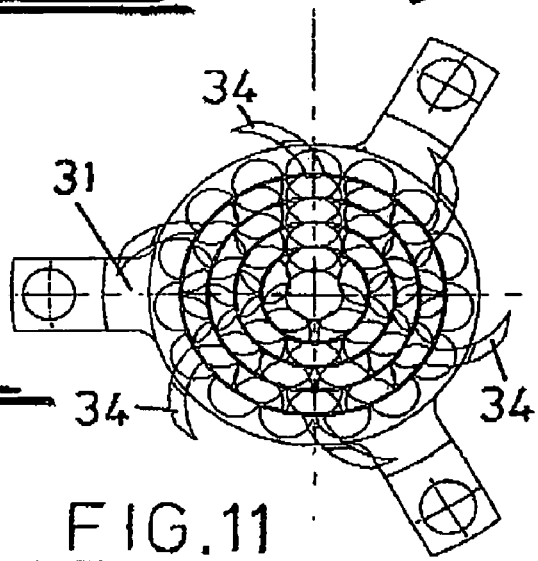
FIG. 11 illustrates the relative positioning of the rotor and stator shown in FIGS. 7 and 10.

FIGS. 9 and 10 illustrate the configuration of the stator and rotor and FIG. 11 illustrates the manner in which the two components overlap ore another. It will be seen that the pattern of projections and cavities is substantially the same as that of for example the embodiment of the invention illustrated in FIG. 1.

Figure 13:
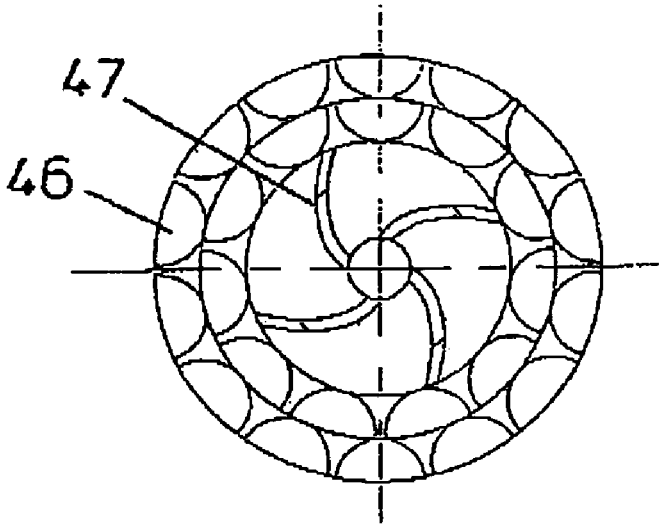
FIG. 13 is a view of the face of the rotor incorporated in the apparatus of FIG. 12.

In the embodiment of the invention illustrated in FIGS. 7 to 11, the rotor incorporates external impellers. An embodiment of the invention illustrated in FIGS. 12 and 13 shows an alternative arrangement incorporating an internal impeller.

Figure 12:
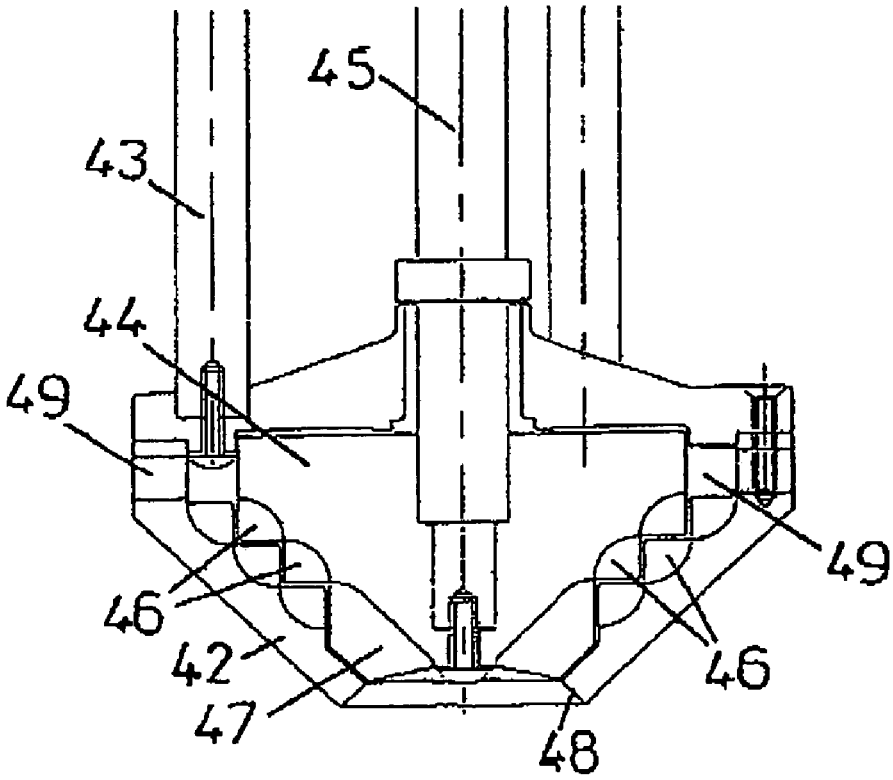
FIG. 12 illustrates a further embodiment of the present invention incorporating an internal impeller.

Referring to FIG. 12, a hollow conical stator 42 is mounted on support rods 43 and a rotor 44 is driven from a shaft 45. The stator 42 defines three projections in each of which part-spherical cavities 46 are formed. The rotor 44 defines two projections in each of which further cavities 46 are formed. The downwardly facing central portion of the rotor 44 supports for impeller vanes 47 to encourage the flow of material from an inlet 48 defined by the stator to outlet 49 also define by the stator.

Figure 14:
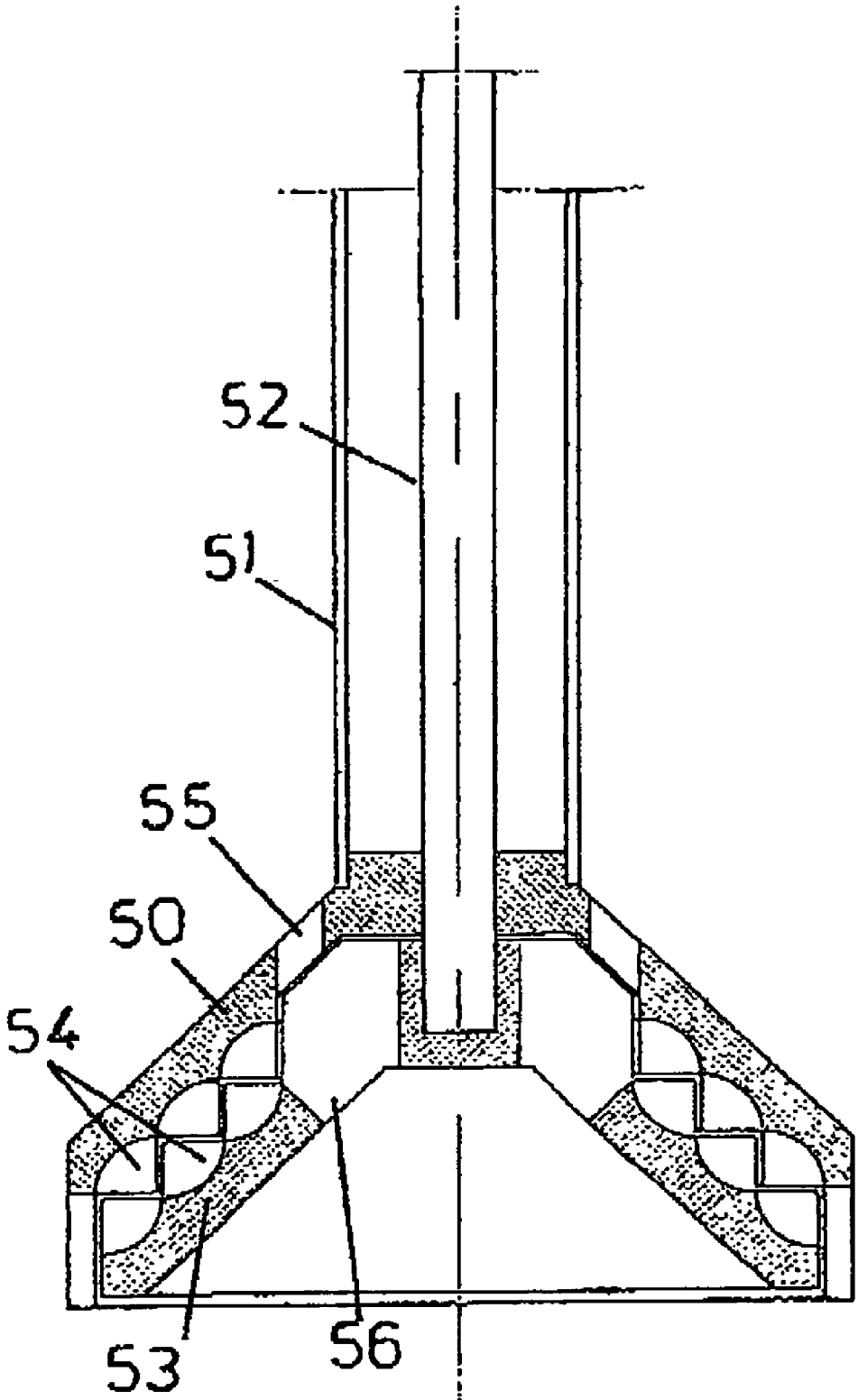
FIG. 14 illustrates a further embodiment of the invention with an inverted structure in which material to be mixed is drawn into a hollow conical rotor structure.

Referring now to FIG. 14, this illustrates a further embodiment of the invention in which the rotor and stator configuration of the embodiment of for example FIG. 12 has been reversed or inverted. Thus in the embodiment of FIG. 14, a hollow conical stator 50 is supported on a tube 51 through which a drive shaft 52 extends to drive a hollow conical rotor 53. Both the stator 50 and rotor 53 are generally conical in shape, the inner surface of the stator 50 defining three projections in each of which cavities 54 are formed and the outer surface of the rotor 53 also defining three projections in which cavities 54 are formed. When the assembly of FIG. 14 is immersed in a fluid and the rotor 53 is driven by the shaft 52, fluid is drawn through inlets 55 defined by the stator and inlet 56 defined by the rotor and pumped outwards through the cavities 34 to the radially outer edge of the rotor 53.

Figure 15:
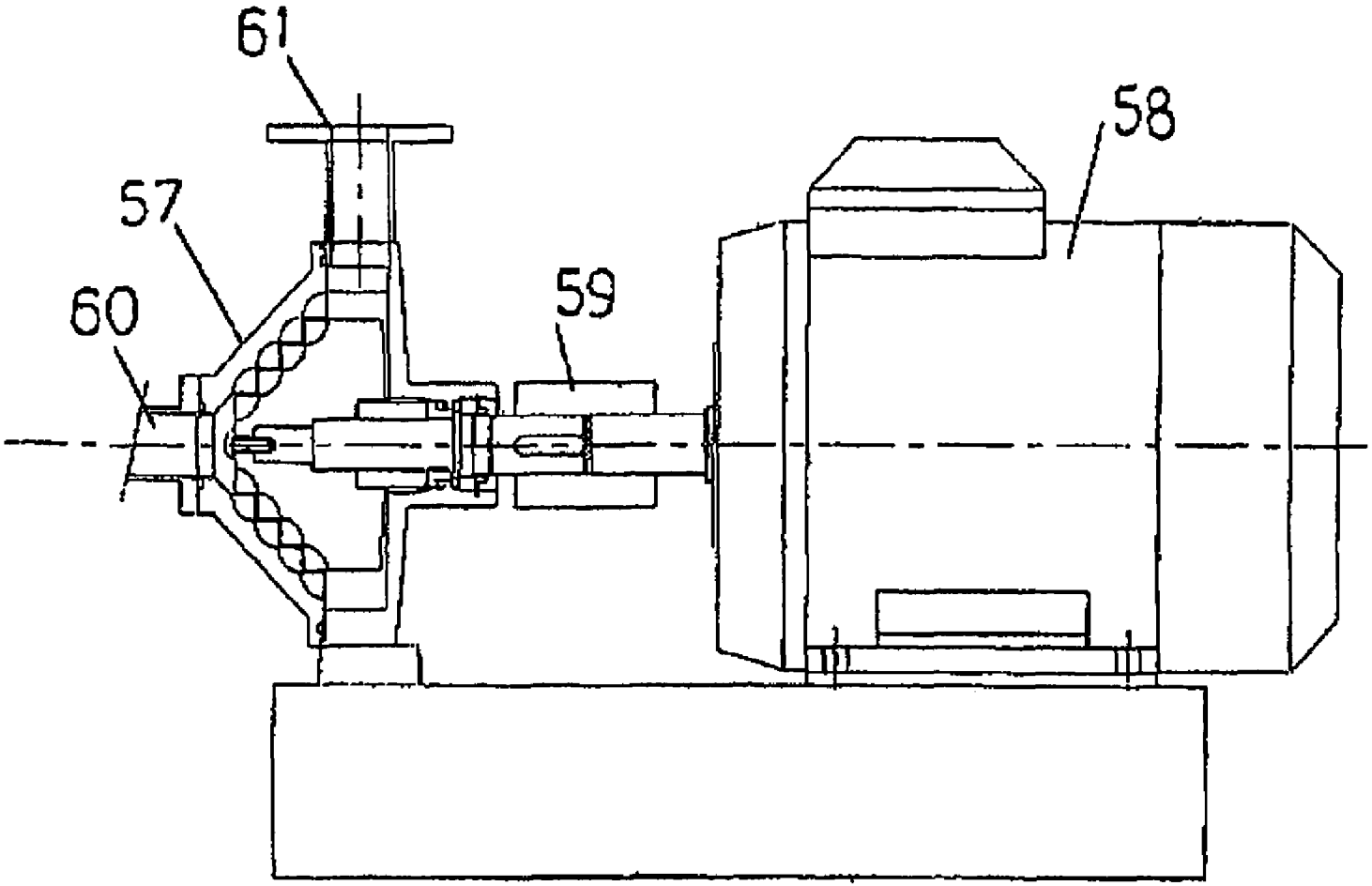
FIG. 15 is a schematic side view of an apparatus installed in a continuous mixing line incorporating a mixer in accordance with the present invention.

FIG. 15 is a simple schematic illustration of a continuous pumping arrangement incorporating a mixer 57 in accordance with the present invention and similar in structure to that of FIG. 1 driven by a motor 58 via a coupling 59. Material to be mixed is delivered to inlet 60 and pumped by the mixer to outlet 61.

Figure 17:
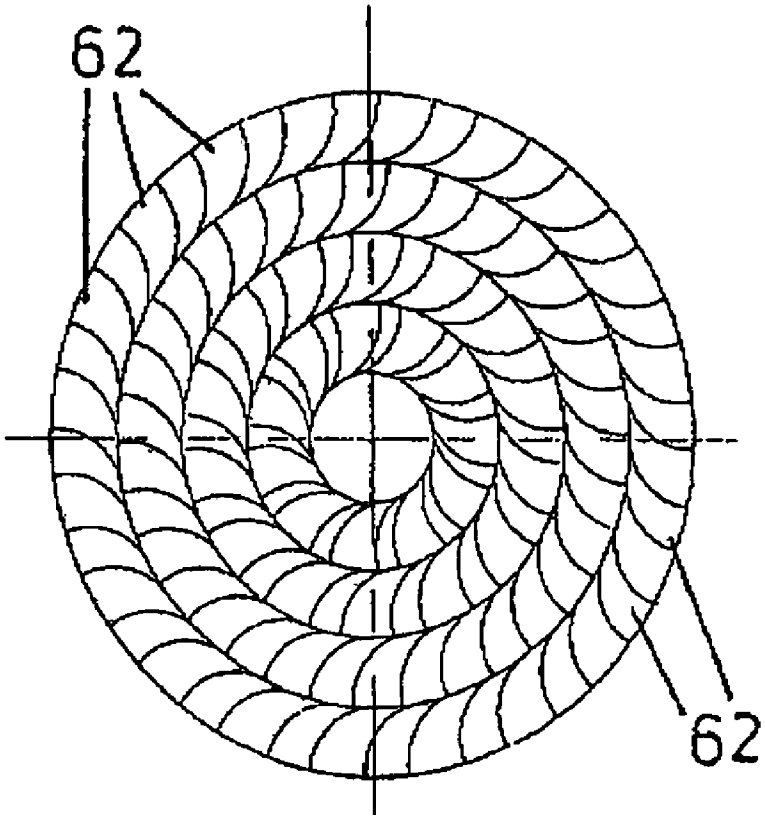
FIG. 17 shows a further alternative cavity configuration which may be used in accordance with the present invention.
Figure 16:
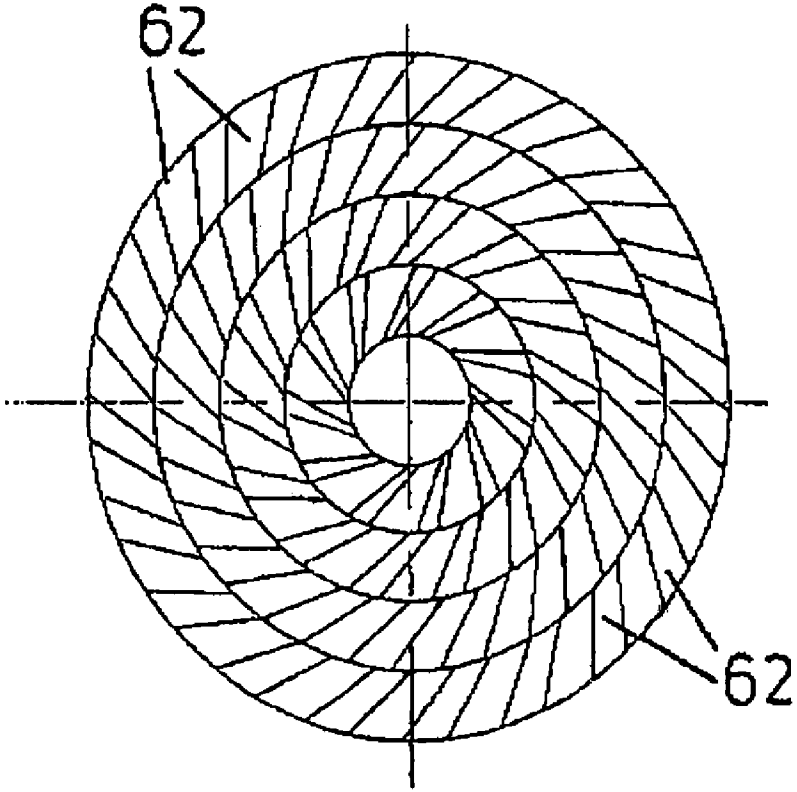
FIG. 16 illustrates an alternative cavity configuration to the part-spherical configurations shown in the above drawings.

As mentioned above, although in all the above described embodiments of the invention cavities of a part spherical configuration are formed in the projections, other cavity configurations are possible, for example those illustrated in FIGS. 16 and 17. In the arrangement of FIG. 16, a generally conical stator arrangement incorporating four projections is shown, each of the projections having formed therein a regularly spaced array of straight-sided but tapering cavities in the form of slots 62. The base of each slot 62 may be straight or curved. For example if the base of each slot is straight it could be inclined at 45° to the rotor axis. If the base of each slot is curved, it could define a part-cylindrical surface. In the latter case, an axial section through slots are straight however such an axial section would be as in FIG. 1 except for the replacement of the curved lines representing part-spherical concave bases to each cavity by straight lines. It will be appreciated that the structure shown in FIG. 16 would generally be used with a rotor having a matching projection and cavity configuration.

The arrangement shown in FIG. 17 is similar to that of FIG. 16 except for the fact that the slots 62 have curved rather than straight-sided edges. In the embodiments of FIGS. 16 and 17, the slots taper and are angled relative to the radial direction. This will affect the pumping action of the device. More generally, the detailed shape of the cavities can be designed to affect various characteristics of the device. In all the described embodiments, each cavity defines a flow path with well-defined entrance and exit zones. The sizes of the entrance and exit zones may differ, for example between cavities in the same row, or between adjacent rows, or between the entrance and exit zones of a single cavity. The ability to select different entrance and exit zone sizes and configurations permits local flow characteristics to be selectively determined by the designer so as to provide desirable characteristics, e.g. different flow velocities and pressures. For example, decreasing the local cross-sectional area of a flow passage increases the velocity of flow through that passage and decreases its pressure. As another example, material flowing from a relatively large exit zone to a relatively smaller entrance zone in an adjacent row of cavities can produce a more finely divided flow.

Referring to the embodiments of FIGS. 16 and 17, it can be seen that the slots taper such that each slot defines a relatively narrow entrance zone and a relatively wide exit zone. This will result in an increase in pressure and a decrease in velocity of material as it passes through the slot. In addition, to the slots are swept back so to tend to act in the manner of turbine vanes so as to throw material in the radially outwards direction and improve the pumping effect.

Figure 18:
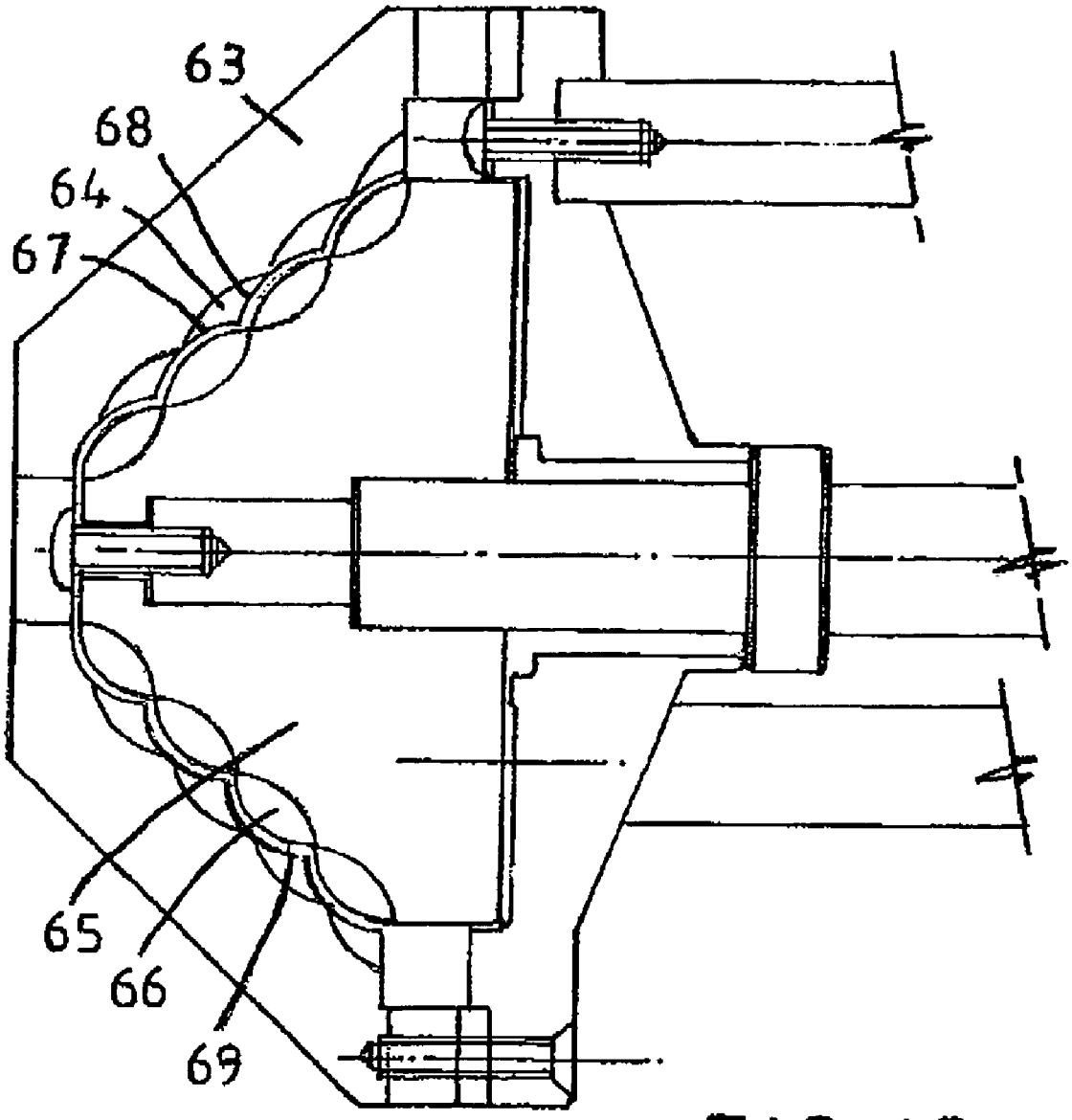
FIGS. 18 and 19 show two alternative cavity configurations in which the projections have curved rather than straight edges.
Figure 19:
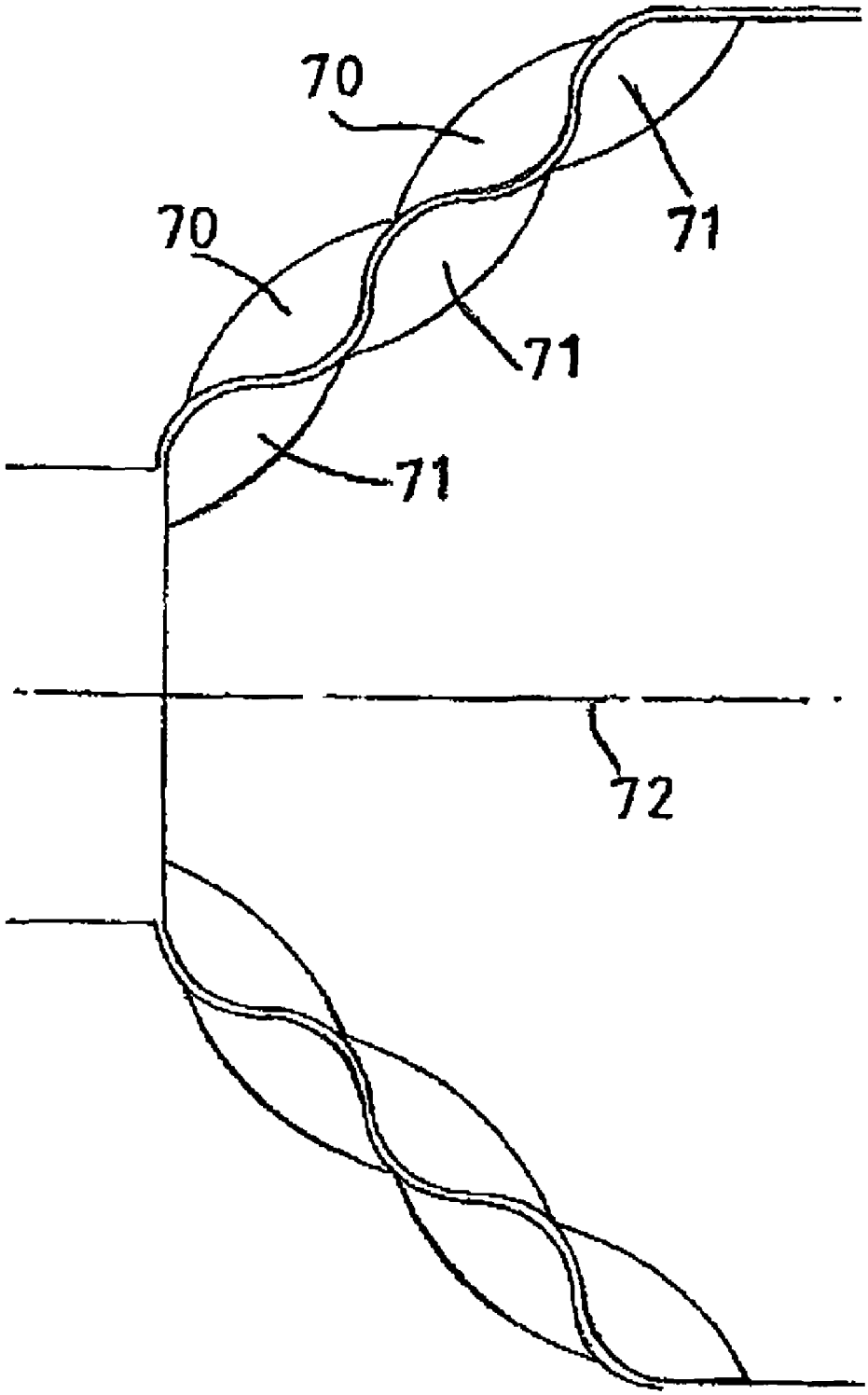

In all of the embodiments described above, the annular surfaces of the projections in which the cavities are formed could be considered as being swept out by straight lines rotated about the axis of rotation of the device. Alternative configurations are possible however such that rather than the projections being swept out by notional straight lines the projections are swept out by notional curved lines. FIGS. 18 and 19 illustrate such configurations.

Referring to FIG. 18, a stator 63 defines four projections in each of which an array of cavities 64 is formed. A rotor 65 defines for annular projections in each of which cavities 66 are formed. Each cavity 64 has a part-spherical base and is formed in a projection defined by two annular curved surfaces 67 and 68. In contrast, although each cavity 66 has a part-spherical base, each of the cavities 66 is formed in a projection defined by a single continuous curve 69.

Referring to FIG. 19, two projections of one component of the device have cavities 70 formed within them, whereas three projections defined by the other part of the device have cavities 71 formed within them. Each of the cavities 70 and 71 has a part-spherical base and an upper surface which is a surface of revolution resulting from rotation of a single arc of a circle around the rotation axis 72.

It will be appreciated that mixing devices in accordance with the present invention could be combined with auxiliary equipment, for example arrangement to cut material into smaller pieces prior to mixing. One possibility for example would be to introduce into the region immediately below the hollow inner rotary member of the embodiment of FIG. 14 a device to cut any material within that region.

The apparatus of the present invention is extremely versatile and can be used in many different applications. For example, the apparatus can be used in all fluid to fluid mixing and fluid to solid mixing applications, including solids that exhibit fluid-like flow behaviour. The fluids may be liquids and gases delivered in single and multiple streams. The apparatus can be used for all dispersive and distributive mixing operations including emulsifying, homogenizing, blending, incorporating, suspending, dissolving, heating, size reducing, reacting, wetting, hydrating, aerating and gasifying for example. The apparatus can be applied in either batch or continuous (in line) operations. Thus the apparatus could be used to replace conventional cavity transfer mixers, or to replace standard industrial high shear mixers. The apparatus could also be used in domestic as well as industrial applications.

The apparatus enables performance levels to be achieved which are far better than those of current state of the art mixers. This is immediate relevance in term of the rate and extent of particle size reduction (fluid and/or solid) and the rate of blending, particularly the incorporation of powders into liquids.

Examples of industries in which the apparatus of the present invention can be applied are bulk chemicals, fine chemicals, petro chemicals, agro chemicals, food, drink, pharmaceuticals, healthcare products, personal care products, industrial and domestic care products, packaging, paints, polymers, water and waste treatment.

The invention claimed is:

1. A dynamic mixer comprising two elements which are rotatable relative to each other about a predetermined axis and between which is defined a flow path extending between an inlet for material to be mixed and an outlet, wherein the flow path is defined between surfaces of the elements each of which surfaces defines a series of annular projections centred on the predetermined axis, the surfaces are positioned such that projections defined by one element extend towards spaces between projections defined by the other element, cavities are formed in each surface to define flow passages bridging the projections, cavities formed in one surface being offset in the axial direction relative to cavities in the other surface, the cavities of the surfaces having curved bases, and cavities in one surface overlapping in the axial direction with cavities in the other surface such that material moving between the surfaces from the inlet to the outlet is transferred between overlapping cavities, wherein the surfaces of the elements which define the projections are generally conical, and wherein one surface is defined by an inner surface of a hollow outer member and the other surface is defined by an outer surface of an inner member, the inlet being defined in the outer member.

2. A dynamic mixer comprising two elements which are rotatable relative to each other about a predetermined axis and between which is defined a flow path extending between an inlet for material to be mixed and an outlet, wherein the flow path is defined between surfaces of the elements each of which surfaces defines a series of annular projections centred on the predetermined axis, the surfaces are positioned such that projections defined by one element extend towards spaces between projections defined by the other element, cavities are formed in each surface to define flow passages bridging the projections, cavities formed in one surface being offset in the axial direction relative to cavities in the other surface, the cavities of the surfaces having curved bases, and cavities in one surface overlapping in the axial direction with cavities in the other surfaces such that material moving between the surfaces from the inlet to the outlet is transferred between overlapping cavities, wherein the surfaces of the elements which define the projections are generally conical, and wherein one surface is defined by an inner surface of a hollow outer member and the other surface is defined by an outer surface of a hollow inner member, the inlet being defined in the inner member.

3. A dynamic mixer comprising two elements which are rotatable relative to each other about a predetermined axis and between which is defined a flow path extending between an inlet for material to be mixed and an outlet, wherein the flow path is defined between surfaces of the elements each of which surfaces defines a series of annualar projections centred on the predetermined axis, the surfaces are positioned such that projections defined by one element extend towards spaces between projections defined by the other element, cavities are formed in each surface to define flow passages bridging the projections, cadvities formed in one surface being offset in the axial direction relative to cavities in the other surface, the cavities of the surfaces having curved bases, and cavities in one surface overlapping in the axial direction with cavities in the other surface such that material moving between the surfaces from the inlet to the outlet is transferred between overlapping cavities, wherein the surfaces of the elements which define the projections are generally conical, and wherein first sections of the elements taper outwards from the inlet and second sections of the elements taper inwards to the outlet.

* * * * *

UNITED STATES PATENT AND TRADEMARK OFFICE

CERTIFICATE OF CORRECTION

PATENT NO. : 7,237,943 B2
APPLICATION NO. : 10/416217
DATED : July 3, 2007
INVENTOR(S) : Christopher J. Brown It is certified that error appears in the above-identified patent and that said Letters Patent is hereby corrected as shown below:

In column 11, line 11, please change “cadvities” to --cavities--

Signed and Sealed this

Fourteenth Day of August, 2007

JON W. DUDAS
*Director of the United States Patent and Trademark Office*